United States Patent [19]

Robinson et al.

[11] Patent Number: 4,724,768

[45] Date of Patent: Feb. 16, 1988

[54] ROCKET-TYPE LINE THROWING APPARATUS

[76] Inventors: Wilfred R. Robinson, 5197 Michener Rd., Sherkston, Ontario, Canada, L0S 1R0; Robert E. Lichtenberger, 555 Rosehill Rd., Fort Erie, Ontario, Canada, L2A 5M4

[21] Appl. No.: 886,883

[22] Filed: Jul. 18, 1986

[51] Int. Cl.[4] ..... F42B 4/06

[52] U.S. Cl. ..... 102/349; 102/358; 102/360; 102/504

[58] Field of Search ..... 102/344, 347, 348, 349, 102/358, 360, 504; 89/1.8, 1.816, 1.819; 42/54

[56] References Cited

U.S. PATENT DOCUMENTS

| | | | |
|---|---|---|---|
| 534,651 | 2/1895 | Krucker | 89/1.819 |
| 1,322,601 | 11/1919 | Newlander | 102/504 |
| 1,418,964 | 6/1922 | Norman | 89/1.819 |
| 2,522,685 | 3/1950 | Mount | 102/504 |
| 2,841,084 | 7/1958 | Carlisle | 102/349 X |
| 2,876,702 | 6/1959 | Wheelwright et al. | 102/89 |
| 3,215,040 | 11/1965 | Kossan et al. | 89/1.819 |
| 3,901,157 | 7/1975 | Taylor | 102/89 |
| 3,903,801 | 9/1975 | Senoski | 102/348 |
| 4,505,179 | 9/1985 | Reynolds et al. | 89/1 G |

FOREIGN PATENT DOCUMENTS

| | | |
|---|---|---|
| 106943 | 2/1906 | Canada . |
| 181826 | 6/1913 | Canada . |
| 469442 | 4/1950 | Canada . |
| 465039 | 7/1950 | Canada . |

*Primary Examiner*—Peter A. Nelson

*Attorney, Agent, or Firm*—Robert M. Phipps

[57] ABSTRACT

A line throwing rocket arrangement is disclosed which is normally stored in a generally rectangular case. The set includes at least one rocket provided with a guide sleeve generally integral with the body of the rocket but disposed exteriorly thereof. During the launching, the sleeve slides over a straight guide rod. The storage case is provided with suitable means for securement of the guide rod to the box at different angles so that different ranges can be covered by the rocket in rescue or the like operations can be covered. The advance in the art is primarily in the simplified arrangement which facilitates the operation and reduces the manufacturing costs of the set.

2 Claims, 9 Drawing Figures

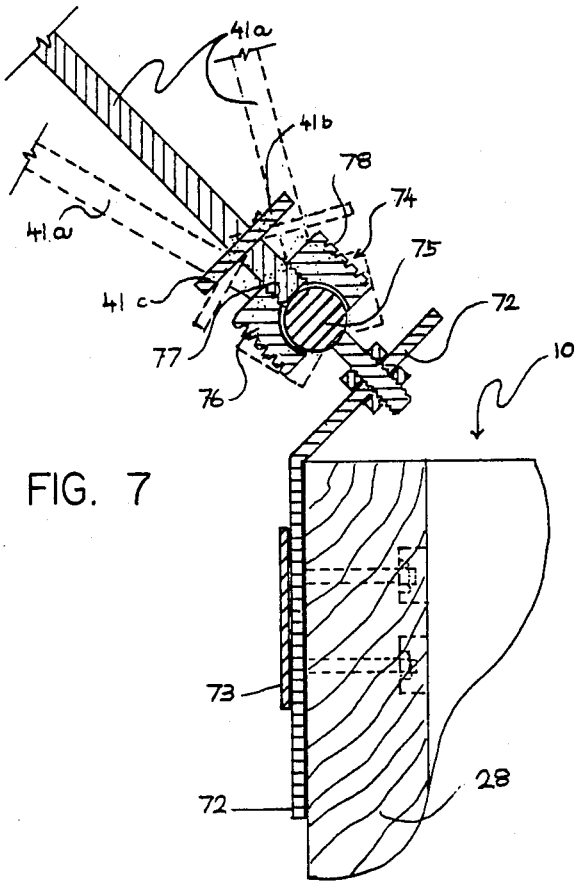
FIG. 7
FIG. 6
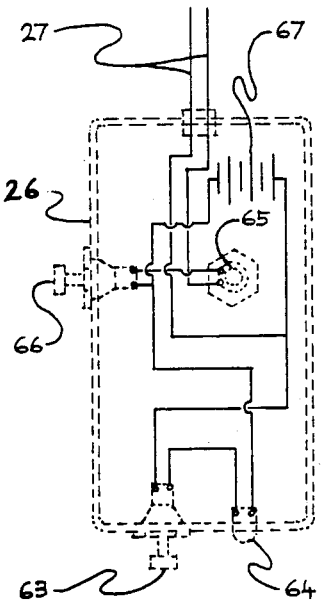
FIG. 8
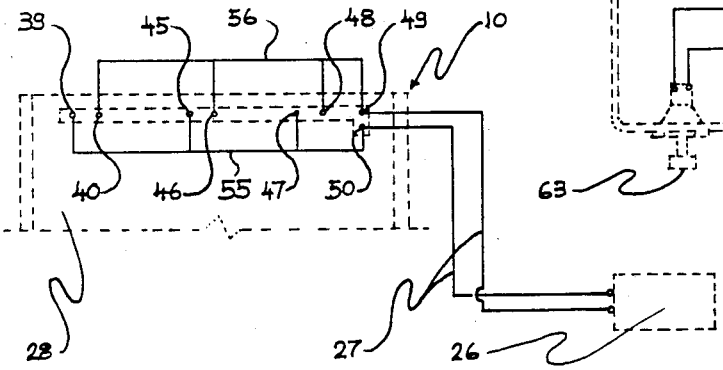

ROCKET-TYPE LINE THROWING APPARATUS

BACKGROUND OF THE INVENTION

The present invention relates to a rocket-type line throwing apparatus, usually but not exclusively used in rescue operations or the like.

Rockets or other projectiles are known to be used for throwing a line from a supply over a predetermined distance. The principle of line throwing has been known for many decades. Thus, Canadian Pat. No. 106,943 (Mingur) issued in 1907, describes an invention entitled "Anchor Projectile" and showing a projectile provided with means for securement of a line to same for anchoring the line to the ground on the shore. Another Canadian Pat. No. 153,334 (McCreary) issued in 1914, describes the use of a projectile within which is arranged a supply of line. One end of the line is anchored close to the gun from which the projectile is launched. Canadian Pat. No. 465,039 and Canadian Pat. No. 469,442, both issued to S. Schermuly in 1950, show further embodiments in which rockets are used in pulling a line in life saving or the like operations.

U.S. Pat. No. 1,418,964 (G. Norman) shows a gun-like line throwing apparatus including a support from which the rocket can be launched at different angles.

Another arrangement capable of launching a projectile to throw a line is disclosed in U.S. Pat. No. 2,522,685 issued to W. W. Mount in 1950. U.S. Pat. No. 2,876,702 (Wheelwright et al.) shows a hand held rocket-type line throwing apparatus which is adapted to be held at a particular inclination (45°) with respect to the point to which the rocket is to be launched. The device is provided with an aperture sight to maintain the desired angle. This device is one of many in which attempts have been made to selectively adjust the angle at which the rocket is launched depending on the distance and character of the object over which the line is to be thrown. Another line throwing equipment is described in a rocket discharge of U.S. Pat. No. 3,901,152 issued to L. Taylor. From the standpoint of the present invention, the device shown in the last mentioned patent is interesting in that it is provided with three longitudinally disposed guide rails for guiding the rocket at the initial stage of launching. Finally, another gun-like device is shown in the line throwing arrangement of U.S. Pat. No. 4,505,179 (Nelson et al).

The object of the present invention is to provide a line throwing rocket-type arrangement which would be relatively simple in structure and operation and would allow selective adjustment of the angle of inclination of the launch of the rocket. Another object of the invention is to provide a kit of the rocket-line throwing arrangement which is convenient for storage of the equipment while not in use, and allows an easy assembly to make the system readily available for launching a line throwing rocket. Another object of the invention is to provide a system as described which would be of relatively low manufacturing costs and would thus become available for users operating small crafts such as pleasure boats due to its compact nature and easy storage when not in use.

SUMMARY OF THE INVENTION

In general terms, the present invention provides, for use in a rocket-type line throwing apparatus, a storage box adapted to receive at least one rocket, ignition means for the rocket, a supply of line to be pulled or thrown by each rocket, a straight launch guide rod for guiding the rocket at an initial stage of the launching thereof, said storage box comprising guide rod mounting means for securement of said rod to the box at an angle relative to a normally generally horizontal flat base of the box.

The present invention can also be defined, in general terms, as a rocket-type line throwing apparatus comprising, in combination: a rocket having a rocket body including a nose cone and a tail unit, the latter being provided with a plurality of tail fins for guiding the rocket in its flight, said tail unit defining a cavity including motor securement means for securing a rocket motor unit within the cavity; ignition means for remotely igniting rocket fuel contained in said rocket motor unit; a supply of a line connected to the rocket and adapted to be pulled off a supply magazine in which the line is arranged in a flaked fashion, as the rocket is propelled away; launch guide means including a straight launch guide rod and a launch guide rod engagement means fixedly secured to the tail unit and adapted to slidingly engage the rod to guide the rocket, during the launching thereof, in a direction generally parallel with longitudinal axis of said rocket; a storage case for receiving and storing said rocket, said ignition means, said motor, said line and said guide rod; and guide rod mounting means for securement of said guide rod to said storage case at a selective angle relative to a generally flat, bottom base of the box, whereby said case serves both as storage means for the kit and as a launching pad for the rocket.

According to one of the preferred embodiments, the guide rod mounting means includes a ball-and-socket joint mechanism including a socket portion and a ball portion, one of said portions being secured to the storage case, the other portion being arranged for securement to the guide rod; and tightening means for tightly securing the ball and the socket portions to each other at a desired position relative to each other.

In another alternative, the guide rod mounting means includes a block fixedly secured to the case and provided with a plurality of openings complementary with said rod, said openings being disposed at different angles relative to the plane of said generally flat base of the case, whereby the angle at which the rocket is launched can be selected by using the appropriate socket.

BRIEF DESCRIPTION OF THE DRAWINGS

The invention will now be described by way of preferred embodiments with reference to the accompanying diagrammatic drawings, not to scale, wherein:

FIG. 6 is a simplified diagrammatic representation of the switch box used in the present arrangement including representation of the operation circuit thereof;

FIG. 7 is a view similar to FIG. 3 but showing, in a partial cross section, only the front wall of the wooden case used in the present invention with an alternate arrangement of the launch plate in accordance with a second embodiment of the present invention;

FIG. 8 is a diagrammatic front view of the representation of FIG. 2 with certain parts omitted and showing the arrangement and electric connections between terminals used in launching the rockets.

DETAILED DESCRIPTION OF THE PREFERRED EMBODIMENTS

Figure 1:
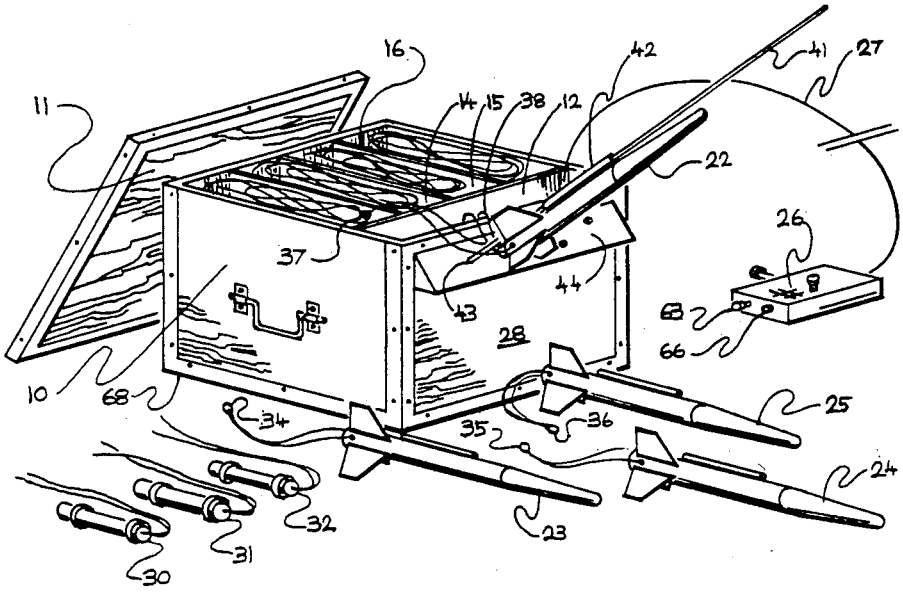
FIG. 1 is a simplified perspective view of a set or kit in accordance with one embodiment of the present invention.

Reference will now be made to FIG. 1 of the drawings, it being understood that the like numerals designate the corresponding parts of the arrangement throughout the drawings. FIG. 1 shows the first embodiment of the present invention by way of an overall view of the entire apparatus or kit. The drawing shows a wooden case 10 provided with a removable lid 11. The case 10 is provided with a transverse partition 12 and with three longitudinal partitions 13, 14 and 15 extending between the partition 12 and a rear wall 16 of the case 10. The partitions 12–15 subdivide the interior of the case 10 into a total of five compartments 17, 18, 19, 20 and 21, of which compartments 17–20 receive each a line arranged in a flaked fashion and ready to be attached to one of the four rockets which are normally stored in the compartment 21 together with the remaining accessories of the apparatus which will now be described in greater detail with particular reference to FIG. 1.

Figure 2:
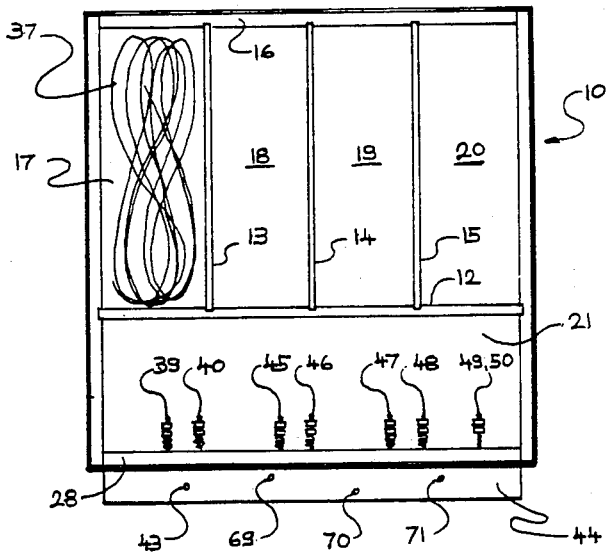
FIG. 2 is a top plan view of the case as shown in FIG. 1, with certain elements shown in FIG. 1 removed for the sake of clarity.

Reference 22, 23, 24 and 25 designate a total of four rockets, it being understood that the number is optional. There is a switch box 26 connected, by a line 27, with a pair of terminals mounted on the front wall 28 of the case 10. The rocket 22 as shown is already provided with its rocket motor 29. The remaining three rockets 23, 24, and 25 are adapted to be provided with their respective motors 30, 31 and 32. As is well known in the art, each rocket 22–25 is provided with a pair of metal wires 33, 34, 35 and 36, provided with an eyelet at their end and remote from the respective rocket by which the respective pair of wires can be connected to the respective line such as line 37 shown in FIG. 1 as being stored in compartment 17. A pair of conductors 38 connects the motor 29 of rocket 22 with a pair of terminals 39, 40 mounted on the front wall 28 of the case 10 (FIG. 2). A straight launch guiding member, in the shown embodiment, a rod 41, is adapted to be slidably engaged with a complementary launch guiding member engagement means, in the shown embodiment, a guide sleeve 42 which is integral with a tail unit of the rocket 22 as will be later described in greater detail. One end of the rod 41 is inserted in an opening 43 provided in a wedge-shaped ledge 44 extending across the front wall 28 near the upper end thereof.

It will be understood that the compartments 17, 18, 19 and 20 are of sufficient size to accommodate appropriate length of line 37, while the front compartment 21 is arranged to conveniently receive all of the rockets and the accessories described above, together with some additional accessories not shown for the sake of simplicity, such as back-up ignition device, service kit etc.

Figure 9:
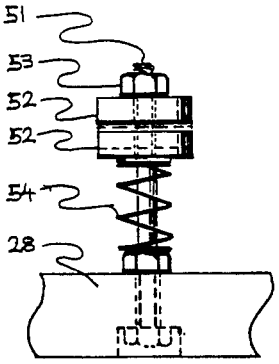
FIG. 9 (on the sheet of FIG. 1) is a partial top view as in FIG. 2 on enlarged scale.

Reference may now be had to FIG. 2 and also to FIG. 8. Shown in those figures is a system of a total of eight terminals 39, 40, 45, 46, 47, 48, 49 and 50. The arrangement of each of the terminals 45–50 (referring only to terminal 47 in FIG. 9) is such that there is a threaded stem 51 on which is slidably received a pair of disks 52 held over the stem by a nut 53 and by a spring 54. Thus, the disks 52 are constantly urged to each other by the action of the spring 54 but can resiliently be separated from each other when an end of wire has to be placed between the disks 52. The disks 52 secure electric connection to a wire placed between them while allowing a relatively easy disengagement between the wire and the disks 52 when pull is exerted upon the wire. FIG. 8 shows that terminals 40, 45, 47 and 50 are connected with each other by a lead line 55 while the remaining terminals 40, 46, 48 and 49 are connected with each other by another line 56.

Figures 3, 4, 5:
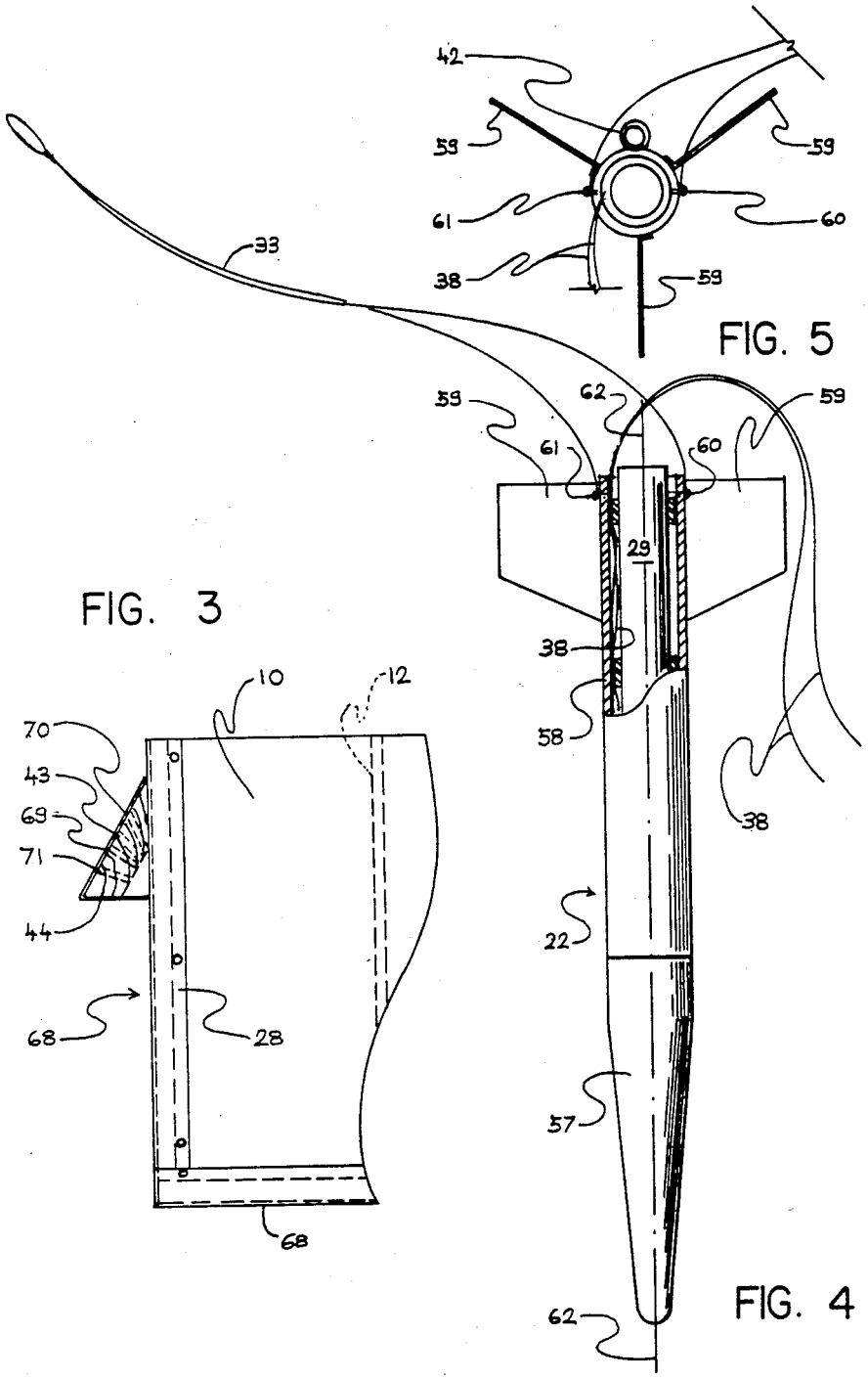
FIG. 3 is a side view of the case as seen in FIG. 2.
FIG. 4 is a side view, partly in section, of a rocket including a rocket motor mounted therein, in a simplified, diagrammatic representation.
FIG. 5 is a rear view of the rocket shown in FIG. 4.

Reference is now made to FIGS. 4 and 5 with a partial reference to FIG. 1. FIGS. 4 and 5 show in greater detail but still diagrammatically the overall arrangement of the rocket 22 as shown in FIG. 1 but removed from the rod 41 and disconnected. The rocket 22, and any of the remaining rockets, includes a wooden nose 57. Wood is preferred even though other materials, e.g. a suitable plastic, are not excluded. At the rear end of the nose 57 is secured a hollow tail unit 58 of the rocket. The tail unit 58 receives in it the associated rocket motor 29 comprising a cylindric housing and two annular sleeves or spacers holding the motor 29 firmly in place. Wires 38 extend from the front end of the motor 29, under the spacers and out of the rear end of the rocket, to be connected with terminals 45 and 46 or with any other pair of terminals, by insertion of the ends of the respective wires between the disks 52 of the respective terminals. The tail unit 58 is provided with three fins 59 spaced from each other at an angle of 120° (see FIG. 5). There are two securement screws 60, 61 at the end of the tail unit 58, securing to the tail unit 58 the associated pair of coupling wires 33 and thus the associated line 37. The tail unit 58 is integral with the guide sleeve 42 which, in the shown embodiment, is cylindric and generally parallel with the axis 62 of the rocket 22. The sleeve is adapted for free sliding over the guiding rod 41. Thus, when the rocket is started, the initial movement of the rocket is guided by sliding the sleeve 42 over the rod 41. During the stage of this guiding, also, the ends of lead lines or conductors 38 are disengaged from the respective pair of terminals 45, 46.

The remaining motors 30, 31 and 32 are ready to be assembled with their associated rockets 23, 24 and 25, as is well known in the art. As is well known, the rocket motors 30, 31 and 32 are adapted to become started by igniting their solid fuel by electricity brought by the respective conductors shown in FIG. 1 as being associated with the motors 30, 31 and 32.

Thus, when electric current flows through conductors 38, the respective rocket motor, such as motor 29, is started to commence the launching of the rocket.

Reference should now be made to FIG. 6 which shows one arrangement of the ignition device or switchbox. The switchbox 26 comprises a total of three switches. Switch 63, is operatively connected with a control light 64. The remaining two switches 65, 66 are arranged, as a safety feature, to be operated simultaneously in order to close the circuit of a battery 67. In other words, if switches 65 and 66 are both depressed (and thus closed), electric current flows in line 27 and thus at terminals 39–40, 45–46, 47–48 and 49–50. If one assumes that any of the pairs of terminals 45–50 is connected by a conductor such as conductors 38 to the respective rocket motor, one can see that it is possible with the arrangement of this device to remotely start a rocket such as rocket 22 by operating the remote place the switches 65, 66 of the switchbox 26.

If the rod 41 is inserted in the first opening 43, it protrudes from the front wall 28 at an angle of approximately 30° relative to the level of the base 68 of the case 10. In actual use of the device in rescue operations or the like, it may be desired to launch the rocket 22 at a steeper angle. With the present invention this can be done by simply inserting the rod 41 into another one of the remaining openings 69, 70 or 71 provided in the ledge 44 of the front wall 28 of the case 10. The axis of the opening 69 is at approximately 45° relative to the said plane of the base 68, while the openings 70 and 71 define and angle of approximately 80° and 60°, respectively. Thus, by simply selecting a suitable opening in the ledge 44, the effective angle at which the rocket is launched is changed in a simple manner.

Another embodiment of the invention which is often even more versatile but is slightly more complex is that shown in FIG. 7. Here the ledge 44 is replaced by a launch plate 72 held by a sleeve 73 to the front wall 28 of the case 10. The end of the rod 41 at the front wall 28 is received in a ball-and-socket joint 74 of a known structure. It comprises a ball or head portion 75 fixedly secured to the launch plate 72 at the upper end thereof. The head 75 is surrounded by a socket 76 the front portion of which is provided with a threaded opening 77 in which is threadably received the end of the rod 41*a*. The rod 41*a* is provided with a pair of wings 41*b*, 41*c* which facilitates, together with a knurled surface 78 on the exterior of the socket 76, the tightening of the rod 41*a* relative to the head portion 75 thus tightening the whole joint 74 to retain the rod 41 at a desired angle both from the standpoint of the slope relative to the normally horizontal plane of the base 68, and sideways. It is not necessary to move the entire case 10 if it decided to change the direction of launch, as would be required in the case of FIG. 7.

The embodiments described above are preferred embodiments of the present invention, it being understood that the present invention can be carried out by way of many other embodiments departing, to a greater or to a lesser degree, from the described embodiments, without departing from the scope of the present invention as recited in the accompanying claims.

We claim:

1. A rocket-type line throwing apparatus comprising, in combination:

(a) a rocket having a rocket body, the body including a nose cone and a tail unit, the latter being provided with a plurality of tail fins for guiding the rocket in its flight, said tail unit defining a cavity forming motor receiving means for placing a rocket motor unit within the cavity;

(b) ignition means for remotely igniting rocket fuel contained in said rocket motor unit;

(c) a supply of aline adapted to become connected to the rocket and to be pulled off a supply magazine in which the line is arranged in a flaked fashion, as the rocket is propelled away;

(d) launch guide meaans including a straight guide rod and a guide rod engagement means fixedly secured to the tail unit and adapted to slidingly engage the rod to guide the rocket during the launching thereof in a direction generally parallel with longitudinal axis of the rocket;

(e) a storage case for receiving and storing said rocket, said ignition means, said motor, said line and said guide rod; and (f) guide rod mounting means for securement of said guide rod to said storage case at a selective angle relative to a generally flat bottom of the case, said mounting comprising a ball-and-socket joint mechanism means having a socket portion and a ball portion, one of said portions being secured to the storage case, the other portion being arranged for securement to the guide rod and tightening means for tightly securing the ball portion and the socket portion to each other at a desired mutual position; whereby said case services both as storage means for the apparatus and as a launching pad for the rocket.

2. A rocket-type line throwing apparatus comprising, in combination:

(a) a rocket having a rocket body, the body including a nose cone anda tail unit, the latter being provided with a plurality of tail fins for guiding the rocket in its flight, said tail unit defining a cavity forming motor receiving means for placing a rocket motor unit within the cavity;

(b) ignition means for remotely igniting rocket fuel contained in said rocket motor unit;

(c) a supply of a line adapted to become connected to the rocket and to be pulled off a supply magazine in which the line is arranged in a flaked fashion, as the rocket is propelled away;

(d) launch guide means including a straight guide rod and a guide rod engagement means fixedly secured to the tail unit and adapted to slidingly engage the rod to guide the rocket during the launching thereof in a direction generally parallel with longitudinal axis of the rocket;

(e) a storage case for receiving and storing said rocket, said ignition means, said motor, said line and said guide rod; and (f) guide rod mounting means for securement of said rod to said storage case at a selective angle relative to a generally flat bottom of the case, said guide rod mounting means including a block fixed secured to the case and provided with a plurality of openings complementary with said guide rod, said being disposed at different angles relative to the plane of said generally flat bottom of the case; whereby the angle at which the rocket is launched can be selected by using an appropriate one of the openings.

* * * * *